US009630398B2

(12) United States Patent
Dumenil et al.

(10) Patent No.: US 9,630,398 B2
(45) Date of Patent: Apr. 25, 2017

(54) ASSEMBLY OF ONE OBJECT WITH A HANDLE AND ONE INK JET MACHINE FOR PRINTING THE OBJECT

(71) Applicant: MACHINES DUBUIT, Noisy le Grand (FR)

(72) Inventors: Francois Dumenil, Chaumes en Brie (FR); Jean-Louis Dubuit, Paris (FR)

(73) Assignee: MACHINES DUBUIT, Noisy le Grand (FR)

( * ) Notice: Subject to any disclaimer, the term of this patent is extended or adjusted under 35 U.S.C. 154(b) by 0 days.

(21) Appl. No.: 14/884,355

(22) Filed: Oct. 15, 2015

(65) Prior Publication Data

US 2016/0107436 A1 Apr. 21, 2016

(30) Foreign Application Priority Data

Oct. 20, 2014 (FR) ..... 14 60088

(51) Int. Cl.
*B41J 2/045* (2006.01)
*B41J 3/407* (2006.01)

(52) U.S. Cl.
CPC ..... *B41J 2/04505* (2013.01); *B41J 3/4073* (2013.01)

(58) Field of Classification Search
CPC ..... B41J 2/04505; B41J 3/4073
See application file for complete search history.

(56) References Cited

U.S. PATENT DOCUMENTS 5,463,948 A 11/1995 Newman
2005/0179721 A1* 8/2005 Jones ..... B41J 2/335 347/19
2011/0048266 A1* 3/2011 Crystal ..... B41J 3/4073 101/483
2012/0098914 A1 4/2012 Dubuit
2014/0028771 A1 1/2014 Yamada

FOREIGN PATENT DOCUMENTS

JP 2000238305 9/2000

* cited by examiner

*Primary Examiner* — Justin Seo
(74) *Attorney, Agent, or Firm* — Davidson, Davidson & Kappel, LLC

(57) ABSTRACT

An assembly of at least one object and a machine for printing the object, the object having an outer surface substantially of revolution around an axis, and a handle. The machine includes four ink jet printheads, at least one object holder and a support on which the object holder is fastened. An actuator moves the support relative to the printheads in at least four print configurations, and the object holder drives rotation of the object around the axis in each printing configuration. A commander commands the object holder to rotate the object relative to the corresponding printhead around the axis from an initial printing position, in which the handle is located near the printhead on one side of the median plane of the printhead, to a final printing position, in which the handle is situated near the printhead on the other side of the median plane.

15 Claims, 13 Drawing Sheets

Figure 1:
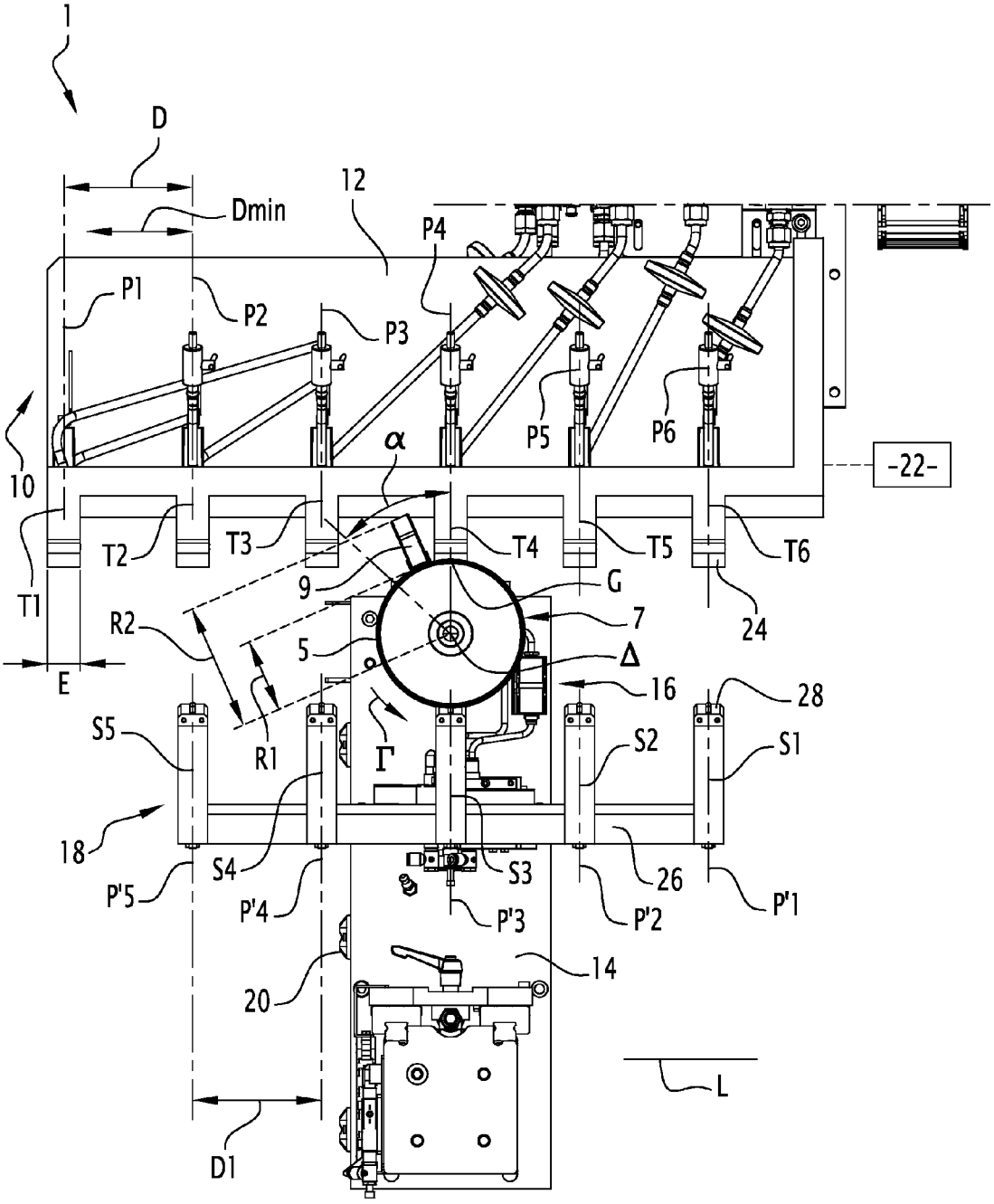

ASSEMBLY OF ONE OBJECT WITH A HANDLE AND ONE INK JET MACHINE FOR PRINTING THE OBJECT

This claims the benefit of French Patent Application 1460088, filed Oct. 20, 2014 and hereby incorporated by reference herein.

The present invention relates to an assembly of at least one object and one machine for printing the object. The object includes an outer surface substantially of revolution around an axis, and a handle protruding radially from the outer surface. The surface is for example substantially cylindrical when the object is a cup or mug.

BACKGROUND

It is known to print on the outer surface of such an object, but the presence of the handle makes that operation difficult and angularly limits the outer surface portion on which it is theoretically possible to print.

Document U.S. Pat. No. 5,463,948 for example describes printing using a screen printing machine. The latter includes a screen whereof the width is slightly smaller than the circumference developed between the handle and the object. Due to the presence of the handle, the relative movements of the object with respect to the screen are complex to implement.

It is further known to print on a small portion of the outer surface of the object using an ink jet printhead. The placement and extension of the printed portion are such that the handle does not pose a problem. However, the outer surface portion that can be printed using an ink jet printhead remains limited, in particular angularly relative to the axis of revolution of the object.

SUMMARY OF THE INVENTION

It is an object of the present invention to provide an assembly of at least one object and a machine for printing the object, the machine including at least four ink jet printheads, the assembly being capable of printing over practically the entire angular extension of the outer surface of the object, with the exception of the portion situated near the handle.

The present invention provides an assembly of at least one object and a machine for printing the object, the object including an outer surface substantially of revolution around an axis, and a handle protruding radially from the outer surface, the machine comprising:

at least four ink jet printheads, each printhead defining a median plane, at least one object holder designed to hold the object and a support on which the object holder is fastened, an actuating system for moving the support relative to the printheads in at least four print configurations in which the object is respectively across from one of the printheads, the object holder being adapted to drive the rotation of the object around the axis in each printing configuration, and a command system for commanding the actuating system, the object holder and the printheads, the command system being able, in each printing configuration, to command the object holder to rotate the object relative to the corresponding printhead around the axis from an initial printing position, in which the handle is located near the printhead on one side of the median plane of the printhead, to a final printing position, in which the handle is situated near the printhead on the other side of the median plane, the handle being moved relative to the printhead following a circular trajectory, preferably uniform, the others of the four printheads being positioned away from the circular trajectory of the handle.

According to specific embodiments, the assembly comprises one or more of the following features, considered alone or according to all technically possible combinations:

the median planes are distributed along a movement direction, are substantially perpendicular to the longitudinal direction, and are preferably distributed regularly in the longitudinal direction;

each printhead includes a lower face designed to be across from the object, the lower face defining a thickness E in the movement direction, the outer surface and the handle respectively define a small radius R1 and a large radius R2 of the object from the axis, and two successive median planes are separated by a same distance greater than or equal to a minimum distance equal to the square root of the difference between the large radius R2 squared and the small radius R1 squared, plus half of the thickness E, the distance preferably being comprised between the minimum distance+1 mm and the minimum distance+5 mm;

the initial printing position and the final printing position together define a nonprintable portion of the outer surface of the object, the nonprintable portion defining an angle relative to the axis, and the command system is configured on the one hand to command the actuating system so as to move the support from a first printing configuration chosen from among the printing configurations to a second printing configuration, and on the other hand to command the object holder so as to simultaneously rotate the object relative to the support around the axis by an angle equal to said angle, the movement of the support and the simultaneous rotation of the object causing the object to go from the final printing position relative to the corresponding printhead in the first printing configuration, to the initial printing position relative to the corresponding printhead in the second printing configuration;

the assembly comprises at least one device for drying the ink, and an actuator of the drying device, the drying device defining a median drying plane and being movable relative to the object holder between an active position, in which the drying device is able to dry at least one layer of ink deposited on the object, and at least one inactive position, in which the drying device is at a sufficient distance from the axis to allow the handle to pass when the object holder rotates the object around the axis;

the command system is able to place the drying device in the active position and to command the object holder to rotate the object relative to the drying device around the axis of an initial drying position, in which the handle is situated near the drying device on one side of the median drying plane, to a final drying position, in which the handle is situated near the drying device on the other side of the median drying plane, then to move the drying device from the active position to the inactive position, the rotation of the object continuing around the axis during said movement of the drying device;

the command system is able to move the drying device from the active position to the passive position by translating the drying device relative to the support substantially in the movement direction;

the assembly comprises a base extending in the movement direction and a plurality of drying devices mounted on the base perpendicular to the movement direction so as to form a rake, the base being mounted movably in the movement direction relative to the support, each drying device being suitable for drying at least one layer of ink respectively deposited by one of the printheads, the command system being configured to move the base in the movement direction relative to the support and to command the object holder so as to simultaneously rotate the object relative to the support around the axis, the movement of the base and the simultaneous rotation of the object causing the object to go from the final drying position relative to one of the drying devices to the initial drying position relative to the other of drying devices;

the assembly comprises at least one drying device mounted movably in the movement direction on the support successively from a first inactive position, designed to be occupied while the drying device has not yet dried one or more layers deposited by one or more printheads; toward the active position designed to be occupied when the drying device is in the process of drying said layer(s) of ink; and then toward a second inactive position, different from the first inactive position and designed to be occupied when the drying device has dried said layer(s) of ink;

the command system is suitable for placing the drying device in the active position while a single layer of non-dry ink has been deposited on the object, and to command the object holder so that the object performs an additional revolution relative to the support around the axis during which the object is not receiving ink and during which the drying device goes from the second inactive position to the first inactive position; and the command system is suitable for placing the drying device in the active position while a second layer of non-dry ink is deposited on a first layer of non-dry ink, and for commanding the object holder so as to perform substantially one additional revolution of the object relative to the support around the axis during which the object receives ink and during which the drying device goes from the second inactive position to the first inactive position.

The invention also relates to a method for printing at least one object, the object including a substantially cylindrical outer surface around an axis, and a handle protruding radially from the outer surface, the method comprising at least the following steps:

providing a machine for printing the object, the machine comprising: at least four ink jet printheads, each printhead defining a median plane; at least one object holder and a support on which the object holder is fastened; a system for actuating the support; and a system for commanding the actuating system, the object holder and the printheads;

carrying of the object by the object holder;

commanding the actuating system via the command system and moving the support via the actuating system relative to the printheads in at least four printing configurations in which the object is respectively across from one of the printheads;

in each printing configuration, commanding the object holder via the command system and rotating the object via the object holder around the axis from an initial printing position, in which the handle is situated near the printhead on one side of the median plane of the printhead, to a final printing position, in which the handle is situated near the printhead on the other side of the median plane, the handle being moved relative to the printhead along a circular trajectory, preferably uniform, the others of the four printheads being positioned away from the circular trajectory of the handle; and commanding the printheads via the command system.

BRIEF DESCRIPTION

Figure 6:
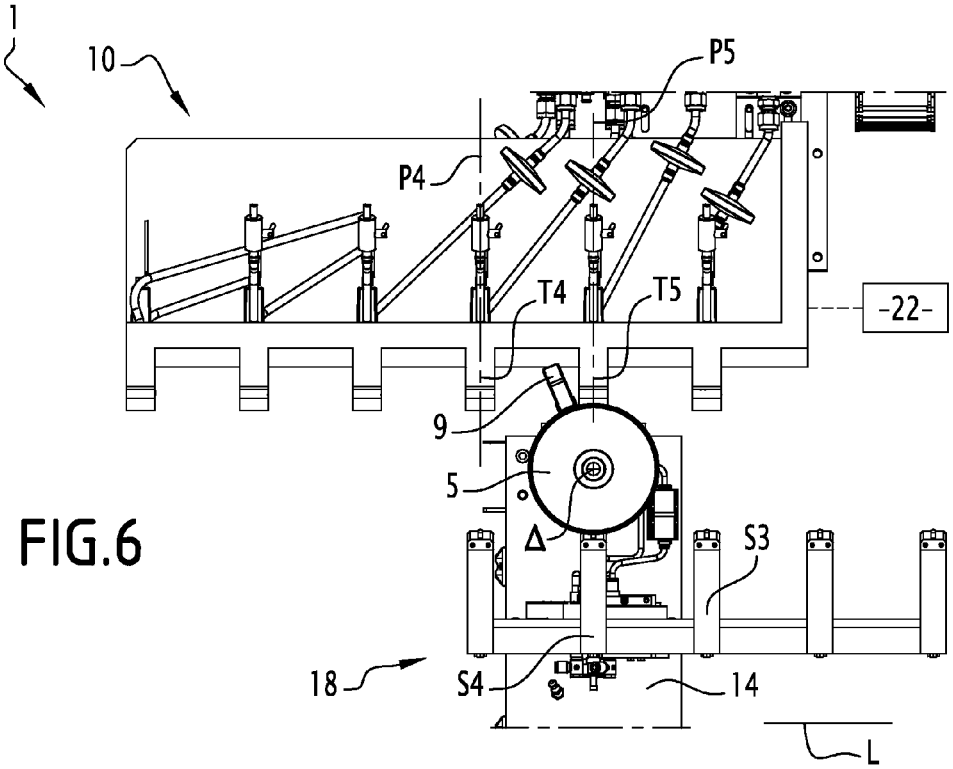
Figure 7:
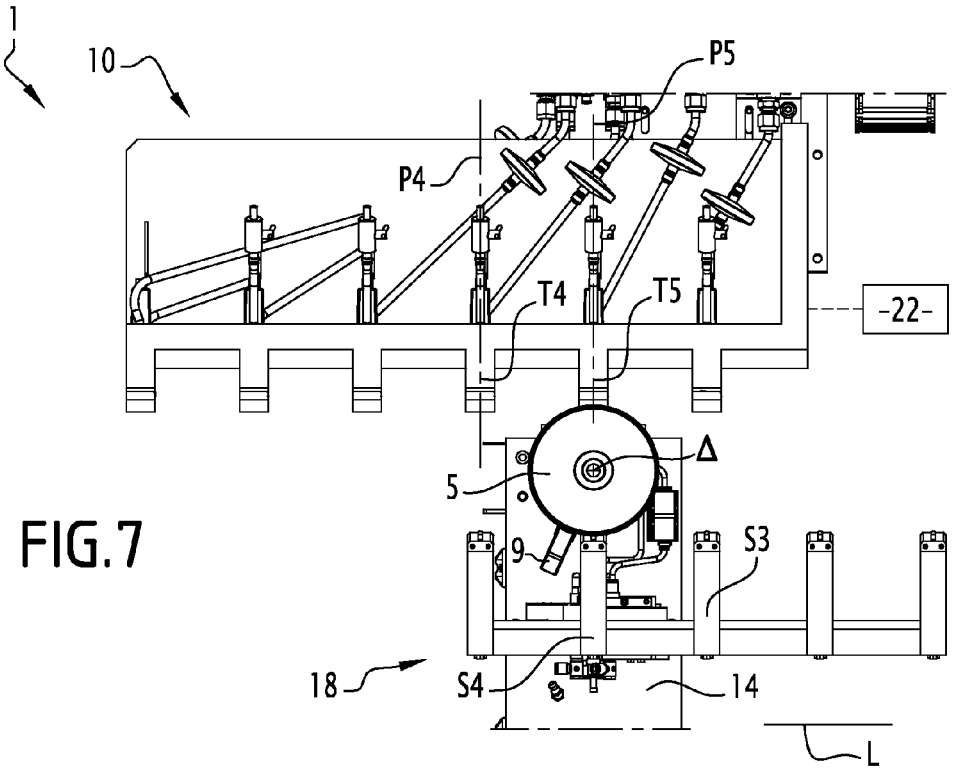
Figure 8:
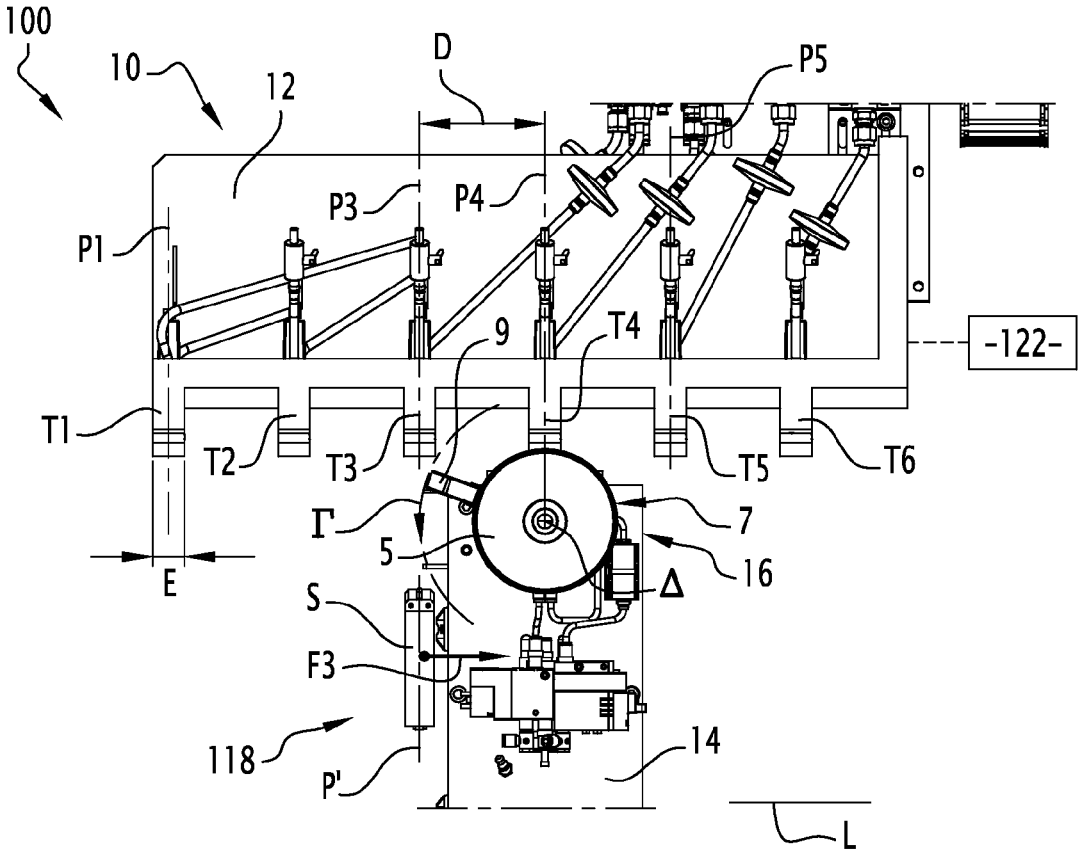
Figure 9:
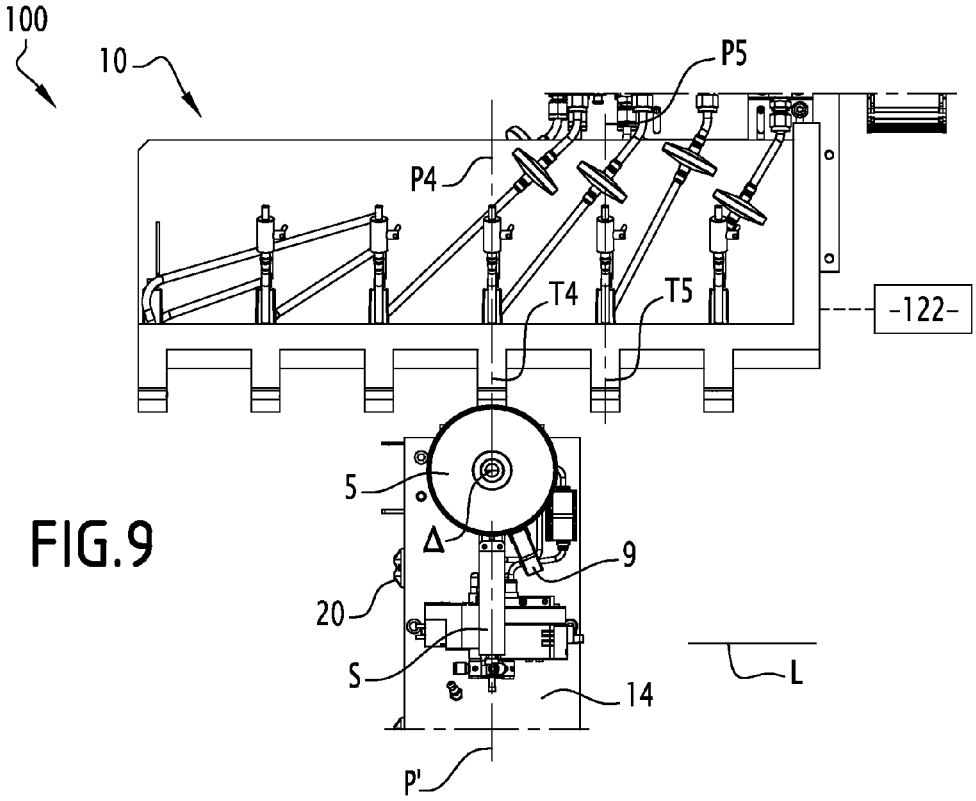
Figure 10:
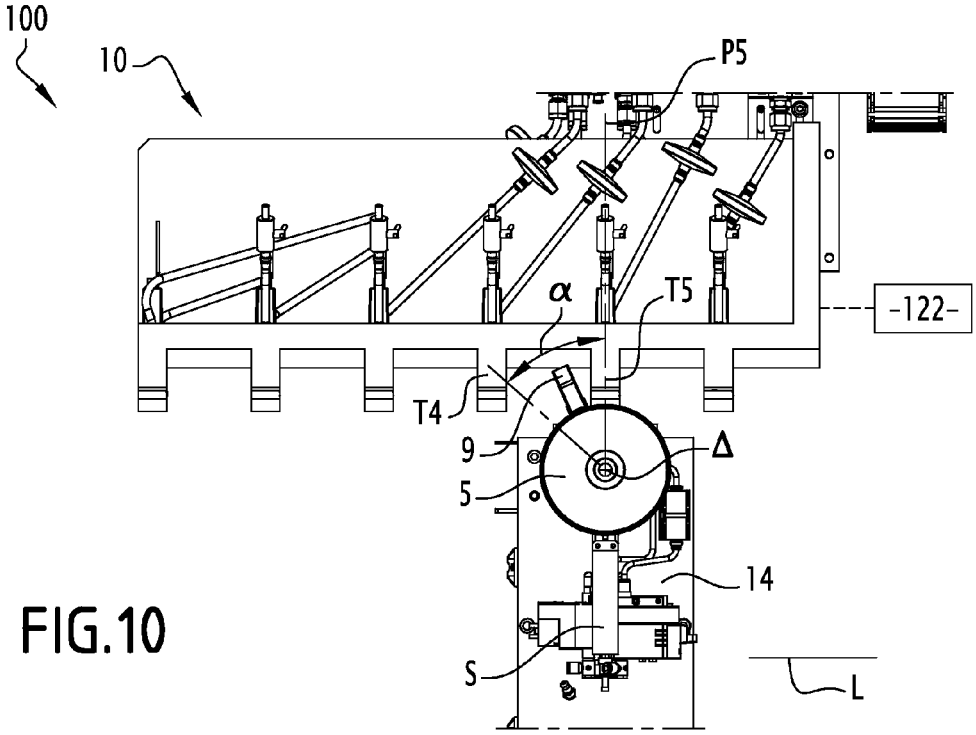
Figure 11:
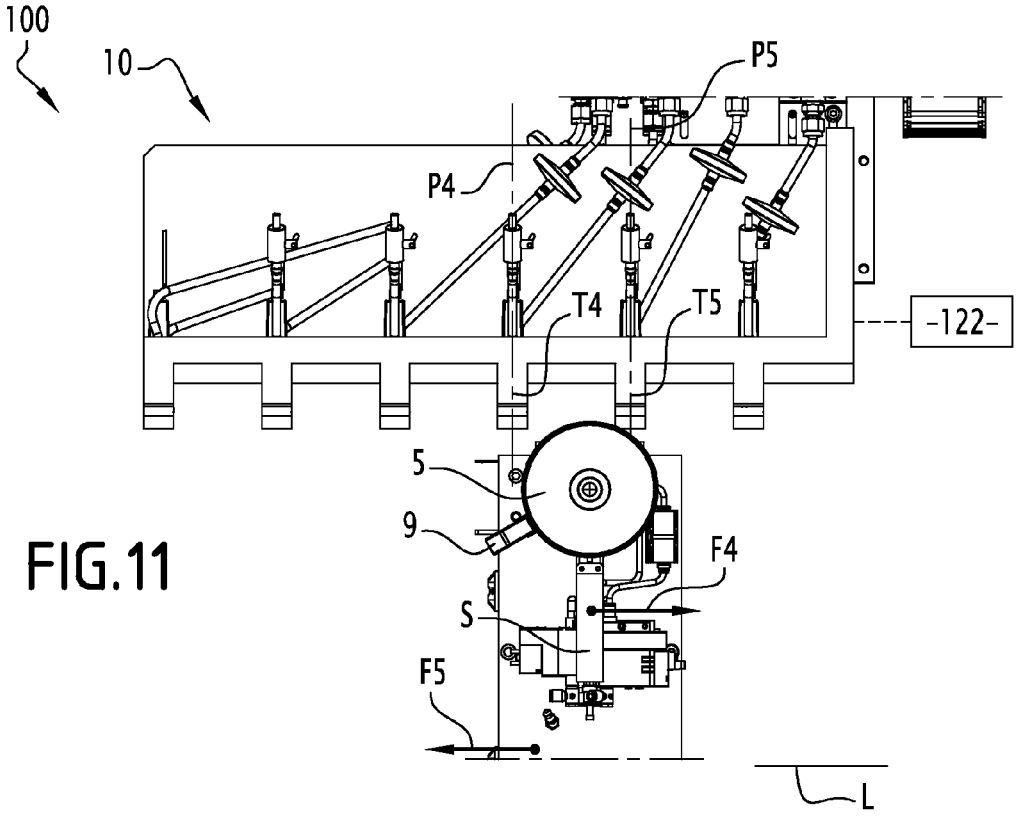
Figure 12:
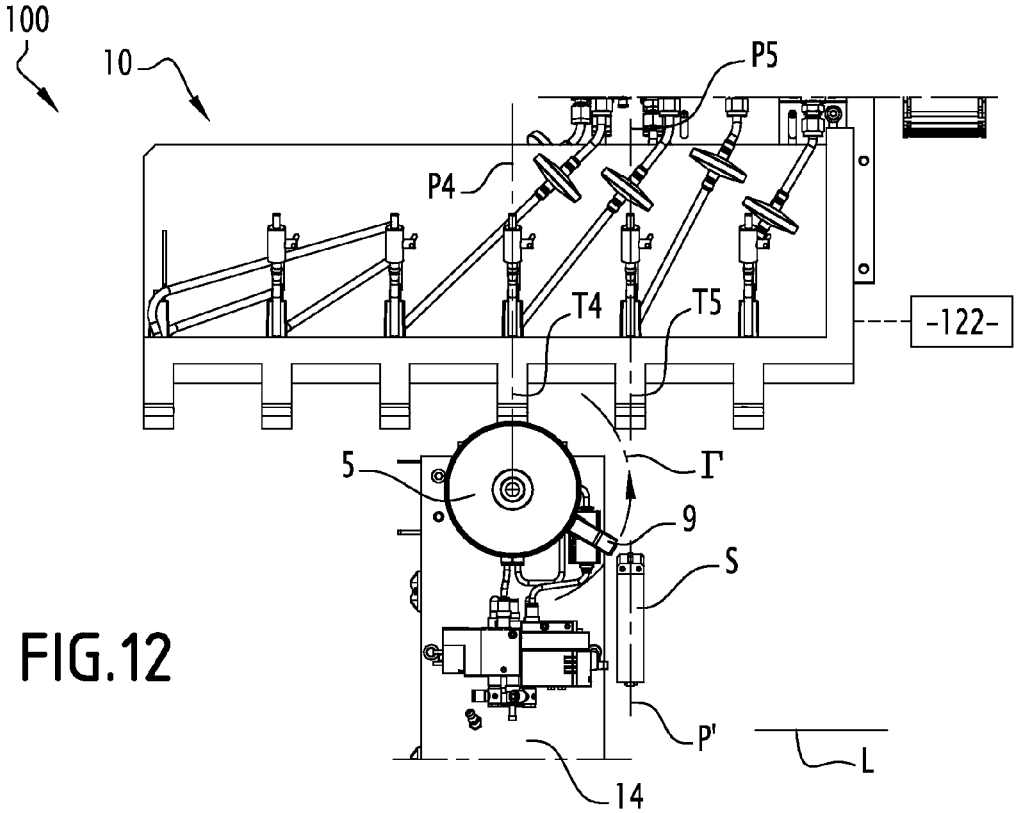
Figure 13:
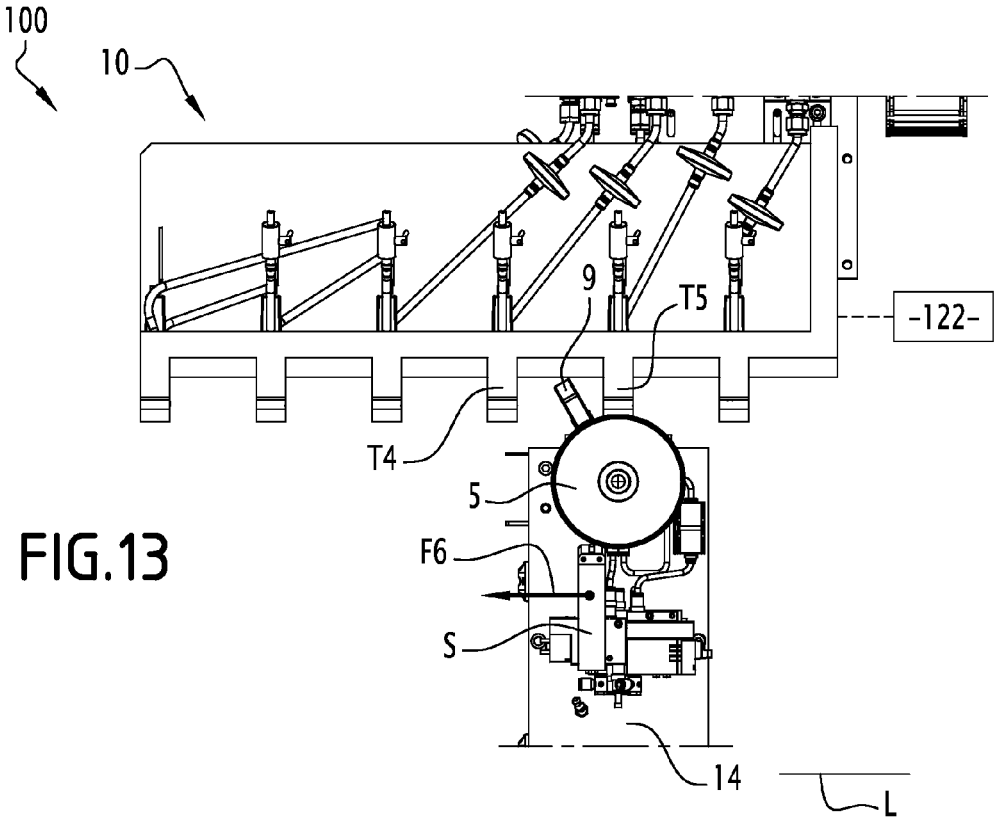
Figure 14:
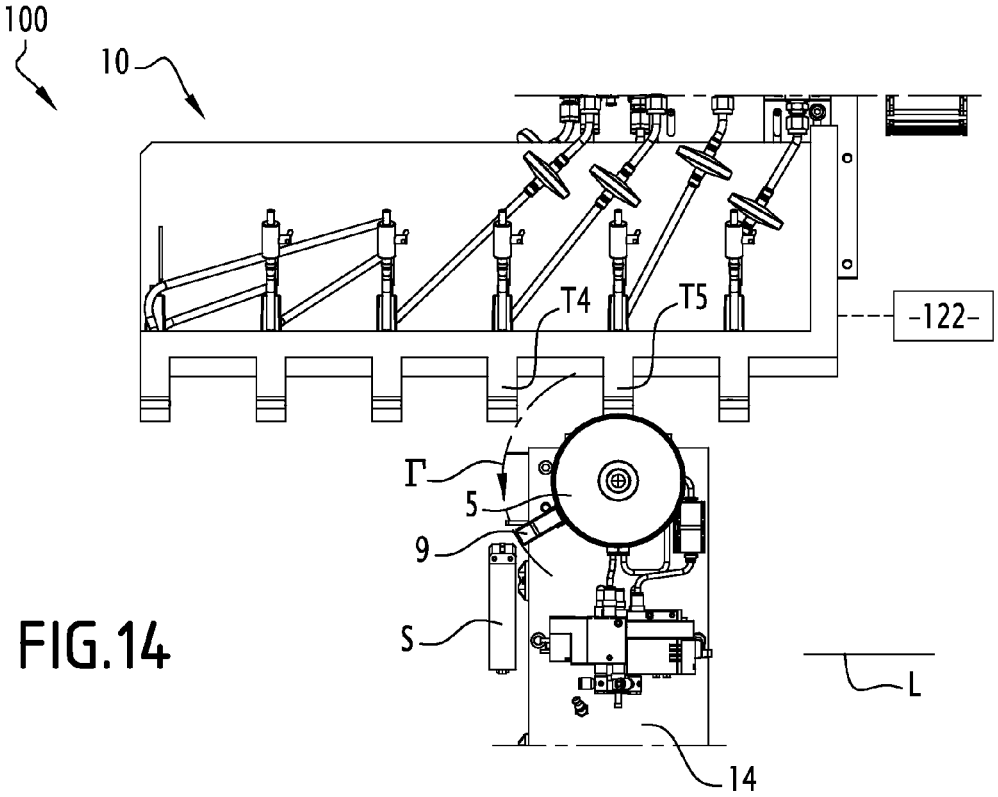
Figure 15:
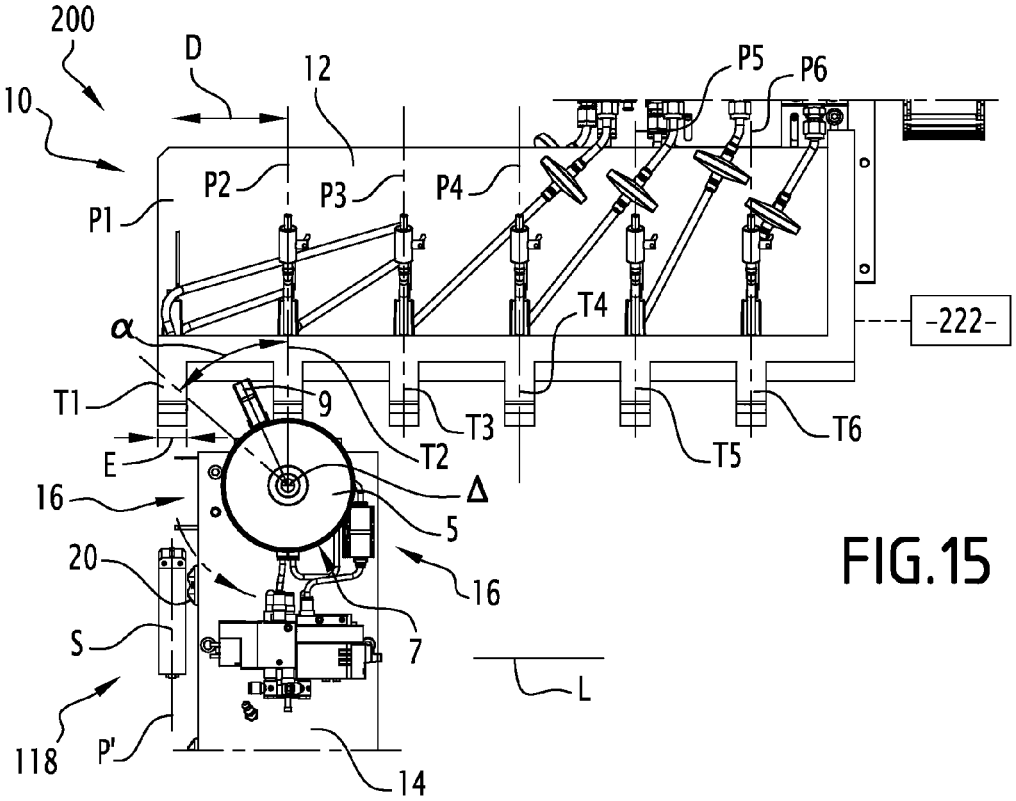

The invention will be better understood upon reading the following description, provided solely as an example and done in reference to the appended drawings, in which:

FIG. 1 is a partial front view of an assembly according to a first embodiment of the invention, the support of the object holder being in the printing configuration corresponding to the fourth printhead, the object being in the initial printing configuration by the fourth printhead, FIGS. 2 to 7 are partial front views of the assembly shown in FIG. 1, the assembly being in different successive configurations during the printing on the object, FIG. 8 is a partial front view of an assembly according to a second embodiment of the invention, FIGS. 9 to 14 are partial front views of the assembly shown in FIG. 8, the assembly being in different successive configurations during printing on the object, FIG. 15 is a partial front view of an assembly according to a third embodiment of the invention, and FIGS. 16 to 24 are partial front views of the assembly shown in FIG. 14, the assembly being in different successive configurations during printing on the object.

DETAILED DESCRIPTION

In reference to FIGS. 1 to 7, an assembly 1 is described according to a first embodiment of the invention.

The assembly 1 comprises an object 5 and a machine 10 for printing the object.

The object 5 comprises an outer surface 7 substantially of revolution around an axis Δ, and a handle 9 protruding radially from the outer surface. The object 5 is for example a cup or mug.

In the illustrated example, the outer surface 7 is slightly conical with axis Δ.

According to an alternative that is not shown, the outer surface 7 is substantially cylindrical with axis Δ.

The outer surface 7 defines a small radius R1 of the object 5 from the axis Δ.

The handle 9 defines a large radius R2 of the object 5 from the axis Δ.

The machine 10 comprises a frame, six printheads T1, T2, T3, T4, T5, T6 fastened on the frame, a support 14 translatable relative to the frame 12 in a longitudinal movement direction L, and an object holder 16 suitable for holding the object 5 and fastened on the support 14. The machine 10 also comprises a drying unit 18 advantageously mounted on the support 14 and translatable in the movement direction L relative to the printheads T1 to T6. The machine 10 also comprises an actuating system 20 for moving the support 14 relative to the printheads T1 to T6 in at least six printing configurations in which the object 5 is respectively across from one of the printheads. The machine 10 lastly comprises a command system 22 able to command the actuating system 20, the object holder 16 and the printheads T1 to T6.

The printheads T1 to T6 are ink jet printheads and are generally plate-shaped. Each printhead T1 to T6 respectively defines a median plane P1 to P6 perpendicular to the direction of the thickness of the printheads. Each printhead T1 to T6 comprises a lower face 24 capable of ejecting ink jets substantially perpendicular to the lower face and substantially parallel to the median plane P1 to P6, respectively.

The printheads T1 to T6 are advantageously positioned parallel to one another, i.e., the median planes P1 to P6 are parallel to one another.

The ink jets ejected by the printheads T1 to T6 are designed to be substantially perpendicular to the outer surface 7.

The lower face 24 is designed to be at a distance from the outer surface 7 advantageously smaller than 2 mm. The lower face 24 has a thickness E (FIG. 1) in the movement direction L.

The median planes P1 to P6 are for example substantially perpendicular to the movement direction L, and for example distributed substantially regularly in that direction. The median planes P1 to P6 are advantageously substantially vertical.

Any two successive median planes chosen from among the median planes P1 to P6 are for example separated by a distance D in the movement direction L.

The axis Δ is for example substantially perpendicular to the movement direction L, and advantageously substantially horizontal.

According to an alternative that is not shown, the axis Δ is slightly inclined in a plane parallel to the median planes P1 to P6, such that an upper generatrix G of the outer surface 7 is substantially horizontal.

For example, the printhead T1 is used to deposit a layer of white ink on the object 5. The printhead T2 is used to deposit a layer of cyan ink. The printhead T3 is used to deposit a layer of magenta ink. The printhead T4 is used to deposit a layer of yellow ink. The printhead T5 is used to deposit a layer of black ink. The printhead T6 is for example used to deposit a varnish.

In each of the printing configurations, the object is advantageously respectively situated below one of the printheads T1 to T6.

Figure 5:
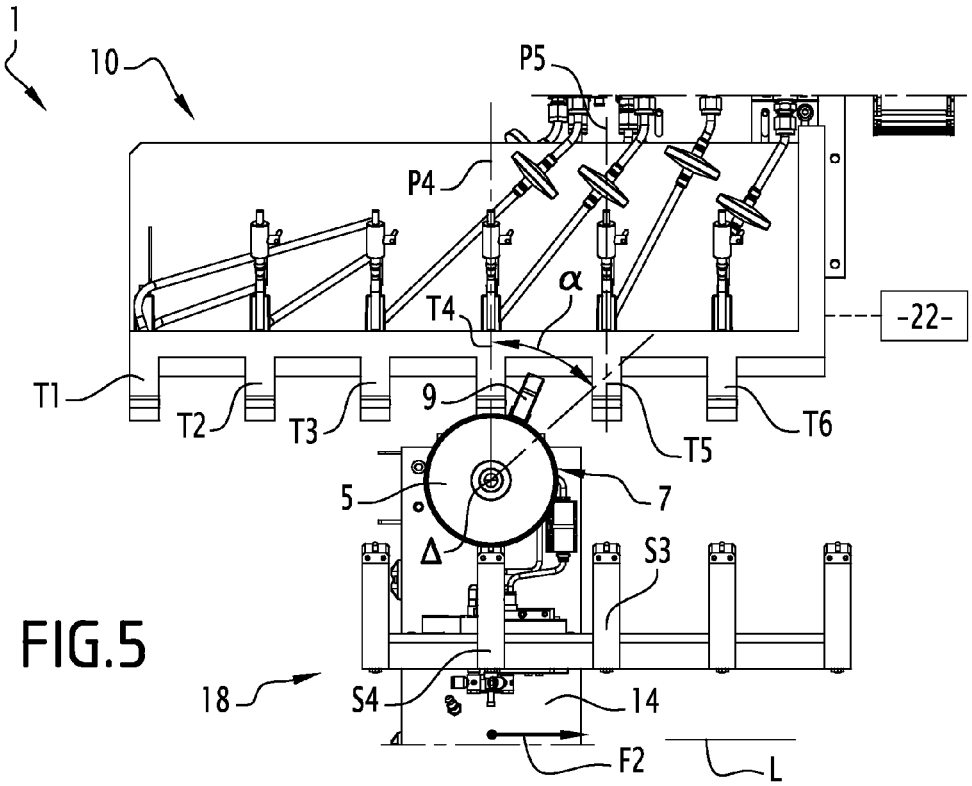

The object holder is able to hold the object 5 by any known means, for example using a mandrel or using a cap-tip system. In each of the printing configurations, the object holder 16 is suitable for rotating the object 5 relative to the corresponding printhead around the axis Δ from an initial printing position (FIG. 1) to a final printing position (FIG. 5).

There is therefore an initial printing position of the object 5 and a final printing position in each printing configuration of the support 14.

For example, in the fourth printing configuration shown in FIG. 1, the initial printing position of the object 5 is such that the handle 9 is situated near the printhead T4, on one side of the median plane P4, for example on the upstream side relative to the movements of the support 14 in the movement direction L.

Here, "near" means that handle 9 does not touch the printhead T4, but is for example situated less than 5 mm from the printhead T4, preferably less than 1 mm from the printhead T4.

Likewise, in the final printing position of the object 5 shown in FIG. 5, the handle 9 is situated near the printhead T4 on the other side of the median plane P4 relative to the initial printing position. Advantageously, the final printing position is substantially symmetrical with the initial printing position relative to the median plane P4.

The object holder 16 is able to move the handle 9 between the initial printing position and the final printing position following a circular trajectory, which is preferably uniform.

In each of the printing configurations, the others of the printheads T1 to T6 are positioned away from the circular trajectory (Γ).

For example, the distance D separating the median planes P1 to P6 is greater than or equal to a minimum distance Dmin equal to the square root of the difference between the square of the large radius R2 and the square of the small radius R1, plus half of the thickness E of the lower face 24.

In mathematical terms, $Dmin=\sqrt{R2^2-R1^2}+E/2$

Advantageously, the distance D is comprised between the minimum distance Dmin+1 mm and the minimum distance Dmin+5 mm.

The initial printing position and the final printing position together define a nonprintable portion of the outer surface 7 of the object 5. This nonprintable portion is situated near the handle 9. The nonprintable portion defines an angle α relative to the axis Δ (FIG. 1).

Depending on the angular extension of the handle 9, the angle α is for example comprised between 10 and 30°.

The drying unit 18 is mounted on the support 14 translatably in the movement direction L. The drying unit 18 comprises a base 26 extending in the movement direction L, and five drying devices S1, S2, S3, S4, S5 fastened on the base.

Each drying device S1 to S5 is able to emit UV radiation suitable for drying a layer of ink deposited on the outer surface 7. The drying devices S1 to S5 are mounted on the base 26 perpendicular to the movement direction L so as to form a rake. Each drying device S1 to S5 comprises an upper surface 28 for example including a row of LEDs (light-emitting diodes) able to emit in the UV range. Each drying device S1 to S5 is generally plate-shaped and respectively defines a median plane P'1, P'2, P'3, P'4, P'5 extending perpendicular to the direction of the thickness of the drying device.

Each drying device S1 to S5 is movable relative to the object holder 16 between an active position, in which the drying device is able to dry a layer of ink deposited on the object 5 by any one of the printheads T1 to T5, and at least one passive position in which drying device is far enough away from the axis Δ to allow the handle 9 to pass when the object holder 16 rotates the object 5.

The drying devices S1 to S5 for example have a width in the movement direction L substantially equal to the width of the printheads T1 to T6.

The median planes P'1 to P'5 are for example substantially perpendicular to the movement direction L and are advantageously successively separated from one another by a distance D1.

The distance D1 is advantageously substantially equal to the distance D.

The command system 22 is configured to command the actuating system 20 so as to move the support 14 from a first printing configuration (for example, the fourth, FIG. 5) chosen from among the printing configurations to a second printing configuration (for example, the fifth, FIG. 6), and to simultaneously command the object holder 16 so as to rotate the object 5 relative to the support 14 around the axis Δ by an angle substantially equal to the angle α.

This movement of the support 14 and the simultaneous rotation of the object 5 cause the object 5 to go from the final printing position relative to the printhead T4 to the initial printing position relative to the printhead T5.

In the active position of any one of the drying devices S1 to S5, the corresponding median plane P'1 to P'5 goes directly through the axis Δ.

The command system 22 is able to place any of the drying devices S1 to S5 in the active position (for example, the drying device S4 in FIG. 4) and command the object holder 16 to rotate the object 5 relative to the drying device around the axis Δ from an initial drying position (FIG. 4, relative to the drying device S4) to a final drying position (for example relative to the drying device S4 of FIG. 7).

In the initial drying position (FIG. 4), the handle 9 is situated near the drying device S4 on one side of the median plane P'4.

In the final drying position (FIG. 7), the handle 9 is situated near the drying device S4, on the other side of the median plane P'4 relative to the initial drying position.

The initial drying positions and the final drying positions are for example substantially symmetrical to one another, respectively, relative to the median plane P'1 to P'5.

The command system 22 is further able to move each drying device S1 to S5 from its active position (for example, the drying device S3 in FIG. 3) to its inactive position (drying device S3 in FIG. 4), the rotation of the object 5 around the axis Δ continuing during that movement of the drying device in question.

The command system 22 is able to move the drying device S3 from its active position (FIG. 3) to its passive position (FIG. 4) by translating the drying unit 18 relative to the support 14 substantially in the movement direction L. This translation simultaneously places the drying device S4 in its active position (FIG. 4), and the drying device S3 in its inactive position.

The operation of the assembly 1 will now be described in reference to FIGS. 1 to 7.

The object 5 is loaded on the object holder 16.

The command system 22 commands the actuating system 20 to move the support 14 successively in the six printing configurations corresponding to the printheads T1 to T6.

The outer surface 7 receives, outside the portion delimited by the angle α, a layer of ink respectively sprayed by each of the printheads T1 to T6. The layers of ink corresponding to the printheads T1 to T5 are respectively dried by the UV rays from the drying devices S1 to S5.

The layer of varnish deposited by the printhead T6 is advantageously dried by another device that is not shown, for example during final drying.

The printing and drying phases are repeated similarly for the printheads T1 to T5 and for the drying devices S1 to S5, thus only one moment of the printing and drying process will be described below relative to the printheads T4 and T5, with the dryers S3 and S4. What happens before or after in the process will be deduced easily by one skilled in the art.

In reference to FIG. 1, the support 14 is in the fourth printing configuration, which means that the object 5 is across from the printhead T4. The object 5 is also in the initial printing position, which marks the beginning of the deposition of the fourth layer of ink, in the example yellow, on the outer surface 7.

The drying device S3 is in its active position. Conversely, the drying device S2 is in its inactive position.

The command system 22 commands the object holder 16 to maintain the rotation of the object 5 relative to the printhead T4 and the drying device S3 around the axis Δ. The rotation is advantageously uniform, which limits the risk of movement of the object 5 relative to the object holder 16.

The printing by the printhead T4 begins, while the dryer S3 is in the process of finishing drying the layer of ink deposited by the printhead T3. The printhead T4 therefore deposits a fourth layer of ink on the third layer of ink that has already dried.

Figure 2:
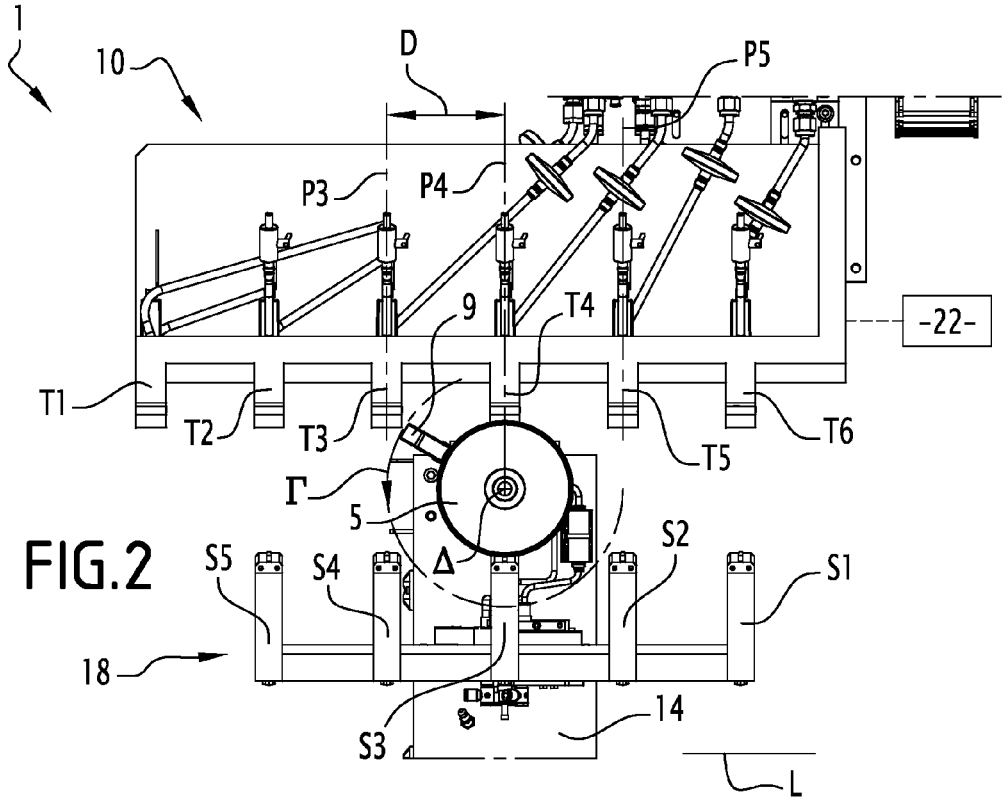

Then, as shown in FIG. 2, the handle 9 moves away from the printhead T4 and passes near the printhead T3 without touching the latter, which is separated from the trajectory Γ of the handle. This is made possible owing to the distance D that separates the median planes P3 and P4.

Figure 3:
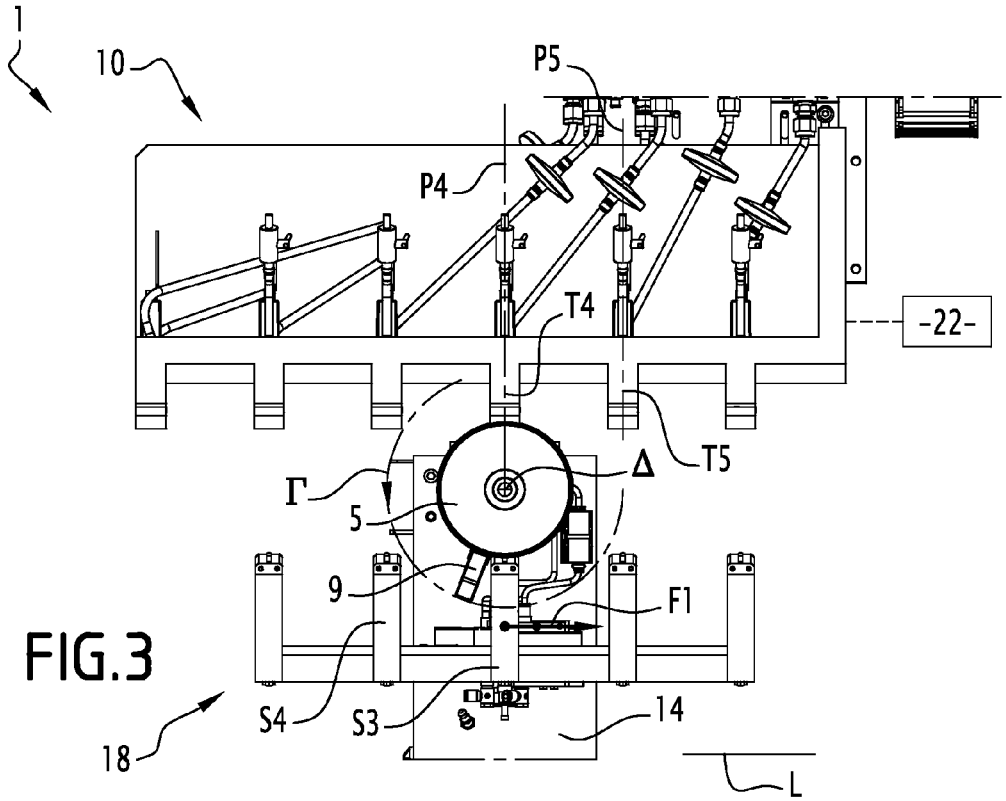

The rotation of the object 5 continuing, the object 5 arrives in the final drying position relative to the drying device S3 (FIG. 3).

Figure 4:
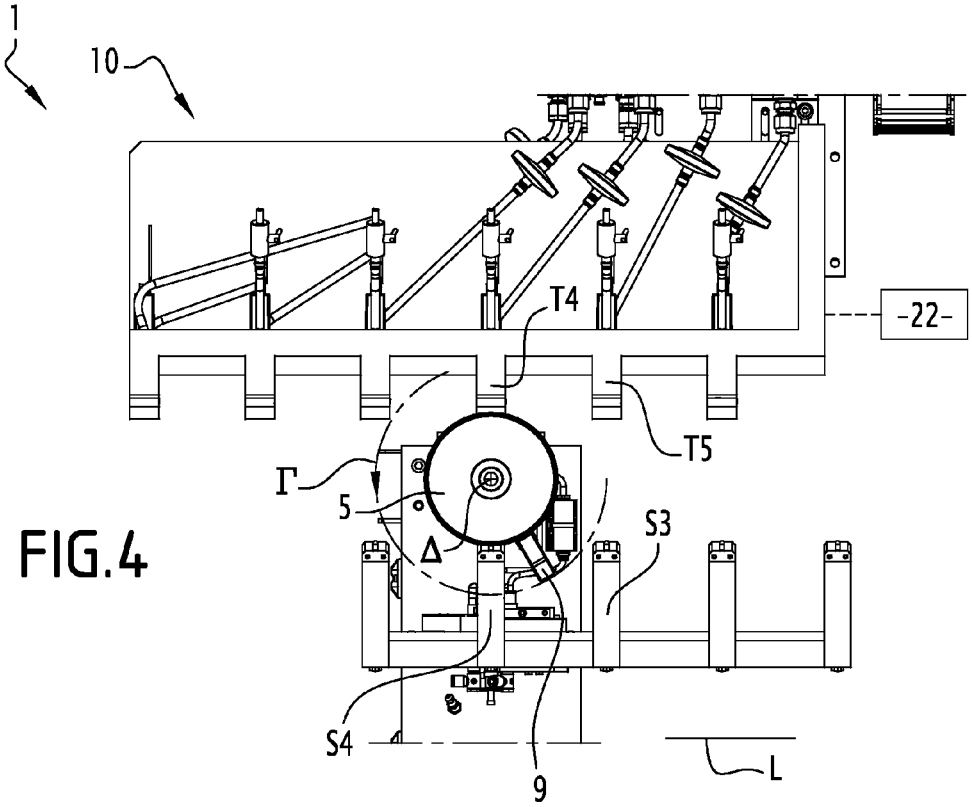

The command system 22 then moves the drying unit 18 relative to the support 14 (arrow F1) in translation in the movement direction L, such that the drying device S3 goes from the active position shown in FIG. 3 to the inactive position shown in FIG. 4. This results in freeing a passage for the handle 9. This also places the object 5 in its initial drying position relative to the drying device S4, for drying of the layer of ink deposited by the printhead T4.

The rotation of the object 5 continuing again, the object 5 arrives in its final printing position of the fourth layer of ink (FIG. 5). The drying device S4 is still in the process of drying the fourth layer of ink.

Without the rotation of the object 5 relative to the support 14 being interrupted, or the drying of the fourth layer of ink by the drying device S4 being interrupted, the command system 22 translates the support 14 relative to the printheads T1 to T6 (arrow F2) in the movement direction L to arrive in the fifth printing configuration (FIG. 6).

Having rotated by an angle equal to the angle α relative to the position shown in FIG. 5, the object 5 is found in FIG. 6 in its initial printing position relative to the printhead T5. The printing of the fifth layer of ink then begins, while the drying device S4 continues to dry the fourth layer of ink.

The rotation of the object 5 still continuing, the object 5 reaches its final drying position relative to the drying device S4 (FIG. 7).

The same operations as previously described are then repeated for the printhead T5 and the drying device S4.

Owing to the features described above, each of the printheads T1 to T6 for ink jet printing deposits a layer of ink or varnish on the outer surface 7, with the exception of the portion defined by the angle α, without the handle 9 colliding with the printheads T1 to T6. The assembly 1 is capable of printing over practically the entire angular extension of the outer surface of the object, with the exception of the portion situated near the handle.

The optional feature according to which the median planes are parallel to one another and regularly distributed in the movement direction L makes it possible to obtain a machine 10 that is easy to manufacture and program.

The optional feature according to which the distance D between two successive median planes of the printheads T1 to T6 is comprised between the minimum distance Dmin+1 mm and the minimum distance Dmin+5 mm makes it possible to obtain a compact machine 10, while preventing the handle 9 from colliding with any of the printheads T1 to T6.

The optional feature according to which the rotation of the object 5 relative to the support 14 around the axis Δ is not interrupted by the command system 22 while the support 14 is moved from one printing configuration to the next cancels or reduces the accelerations experienced by the object 5. This reduces the risk of incorrect identification of the object 5 relative to its support, which may lead to a decrease in printing quality.

Owing to the presence of the drying devices S1 to S5, the layers of ink deposited by the printheads T1 to T5 are successively dried without the printing process being disrupted. This allows a good printing rhythm.

The optional feature according to which each drying device S1 to S5 is retracted upon passage of the handle 9 by translation in the movement direction L makes it possible not to interrupt the rotation of the object 5 relative to the support 14, with the aforementioned benefits.

The optional rake shape of the drying unit 18 makes it possible to simplify the machine 10 and simplify the movements of the drying devices S1 to S5 relative to the object 5.

In reference to FIGS. 8 to 14, the assembly 100 is described according to a second embodiment of the invention.

The assembly 100 is similar to the assembly 1 shown in FIGS. 1 to 7. Similar elements bear the same numerical references or are designated by the same letters, and will not be described again. Only the differences with respect to the assembly 1 will be described in detail below.

The assembly 100 differs in that the machine 10 comprises a drying unit 118 only having a single drying device S, furthermore similar to the drying devices S1 to S5 shown in FIGS. 1 and 7.

Furthermore, the machine 10 of this assembly 100 comprises a command system 122 able to sequence the printing by the printheads T1 to T6 and the drying by the drying device S differently.

The drying device S is mounted translatably in the movement direction L on the support 14 successively between a first inactive position shown in FIGS. 8 and 14, the active position already described and designed to be occupied while the drying device S is in the process of drying a layer of ink (FIGS. 9 and 10), and the second inactive position shown in FIG. 12.

The drying device S defines a median plane P' advantageously substantially perpendicular to the movement direction L.

The first inactive position is designed to be occupied while the drying device S has not yet dried a layer of ink deposited by one of the printheads T1 to T5. In the first inactive position, the device S is for example situated on one side of the support 14 in the movement direction L, advantageously across from one of the printheads.

The second inactive position is different from the first inactive position and designed to be occupied while the drying device S has already dried said layer of ink. In the second inactive position, the drying device S is situated on the other side of the support 14 relative to the first inactive position in the movement direction L. In the second inactive position, the drying device S is advantageously across from one of the printheads.

In the first inactive position and the second inactive position, the median plane P' is for example situated at a distance D1 from the location that it occupies in the active position.

The command device 122 is suitable for placing the drying device S in the active position while a layer of ink is in the process of being deposited on the object 5, and for commanding the object holder 16 such that the object performs an additional revolution relative to the support 14 around the axis Δ during which the object is not receiving ink and during which the drying device goes from the second inactive position to the first inactive position.

The operation of the assembly 100 will now be described in reference to FIGS. 8 to 14.

The operation of the assembly 100 is similar to that of the assembly 1, but differs in the details, since the drying unit 118 only includes the drying device S.

The printing phases by the printheads T1 to T5 and the drying phases being repeated identically, only the printing of the printhead T4 is therefore described below.

At the beginning of printing by the printhead T4, the support 14 is in the fourth printing configuration as shown in FIG. 8. The printing by the printhead T4 begins when the object 5 is in the initial printing position relative to the printhead T4.

The object 5 being substantially uniform in rotation relative to the support 14 around the axis Δ, the object is next found in the position shown in FIG. 8. The handle 9 passes near the printhead T3 without touching it.

The drying device S is in the first inactive position. Shortly after having passed near the printhead T3, the handle 9 also passes near the drying device S without touching it.

The command system 122 moves the drying device S from the first inactive position (FIG. 8) to the active position (FIG. 9) along an arrow F3. The object 5 is then in the initial drying position shown in FIG. 9. The drying then begins on the fourth layer of ink.

The object 5 continues its rotation around the axis Δ and arrives in the final printing position relative to the printhead T4.

The printing by the printhead T4 is interrupted. The command system 122 commands the actuating system 20 to move the support 14 to the fifth printing configuration shown in FIG. 10, the rotation of the object 5 continuing such that the object is found in the theoretical initial printing position relative to the printhead T5.

At that moment, the drying of the fourth layer of ink is not complete. The printing by the printhead T5 does not begin (which is why the initial printing position is called "theoretical" in the preceding paragraph), contrary to what happens in the first embodiment described above.

The drying of the fourth layer of ink by the drying device S continues. When the handle 9 has passed near the printhead T4, the command device 122 commands the actuating system 20 to move the support 14 again toward the fourth printing configuration along an arrow F5 shown in FIG. 10.

The rotation of the object 5 continuing, the handle 9 soon arrives in the final drying position relative to the drying device S. After cutting the current powering the LEDs, the command system 122 then actuates the drying device S to move along an arrow F4 (FIG. 11) from the active position to the second inactive position shown in FIG. 12.

As shown in FIG. 12, the handle 9 next passes in the vicinity of the drying device S without touching it.

Then, the object 5 arrives in the theoretical final printing position relative to the printhead T4. The command system 122 then moves the support 14 again toward the fifth printing configuration. The object 5 having rotated, it is found in the initial printing configuration relative to the printhead T5 as shown in FIG. 13.

After the handle 9 has passed near the drying device S (FIG. 12), the command system 122 moves the drying device S along an arrow F6 visible in FIG. 13 to resituate the drying device in the first inactive position shown in FIG. 14. The printing by the printhead T5 begins. The assembly 100 is then in a configuration similar to that shown in FIG. 8, except that the support 14 is offset in the fifth printing configuration and the printhead T5 is activated to deposit the fifth layer of ink.

Owing to the features described above, each of the inkjet printheads T1 to T6 deposits a layer of ink or varnish on the outer surface 7, with the exception of the portion defined by the angle α, without the handle 9 colliding with any of the printheads T1 to T6. The assembly 100 is capable of printing over practically the entire angular extension of the outer surface 7 of the object, with the exception of the portion situated near the handle 9.

The assembly 100 has advantages comparable to those of the assembly 1 shown in FIGS. 1 and 7, except that the printing rhythm is substantially divided in half.

The assembly 100 further has the advantage of only having a single drying device S. This makes it possible to reduce the cost of the machine 10, in return for greater complexity in the printing process in particular reflected by the fact that the object 5 performs an additional revolution during which it does not receive ink. Thus, the assembly 100 is less expensive than the assembly 1, but its printing rhythm is slower.

In reference to FIGS. 15 to 22, an assembly 200 is described according to a third embodiment of the invention.

The assembly 200 is similar to the assembly 1 shown in FIGS. 1 to 7, and even more to the assembly 100 shown in FIGS. 8 to 14. Similar elements bear the same numerical references or are designated by the same letters, and will not be described again.

Only the differences between the assembly 200 and the assembly 100 shown in FIGS. 8 to 14 will be described in detail below.

Indeed, the assembly 200 is structurally similar to the assembly 100 and only differs by the fact that it includes a command system 222 suitable for placing the single drying device S in the active position while a second layer of non-dry ink is deposited on a first layer of non-dry ink. The command system 122 is further adapted to command the object holder 16 so as to cause the object 5 to perform an additional revolution relative to the support 14 around the axis Δ during which the object 5 receives ink and during which the drying device S goes from the second inactive position to the first inactive position.

The operation of the assembly 200 will now be described in reference to FIGS. 15 to 24.

The operation of the assembly 200 is relatively similar to the operation of the assembly 100, except that the drying by the drying device S occurs on two superimposed layers of non-dry ink.

More specifically, in reference to FIG. 15, the support 14 is for example in the second printing configuration. The object 5 is in the initial printing position relative to the printhead T2 and has not yet received ink in the described example.

The drying device S is in the first inactive position.

Figure 16:
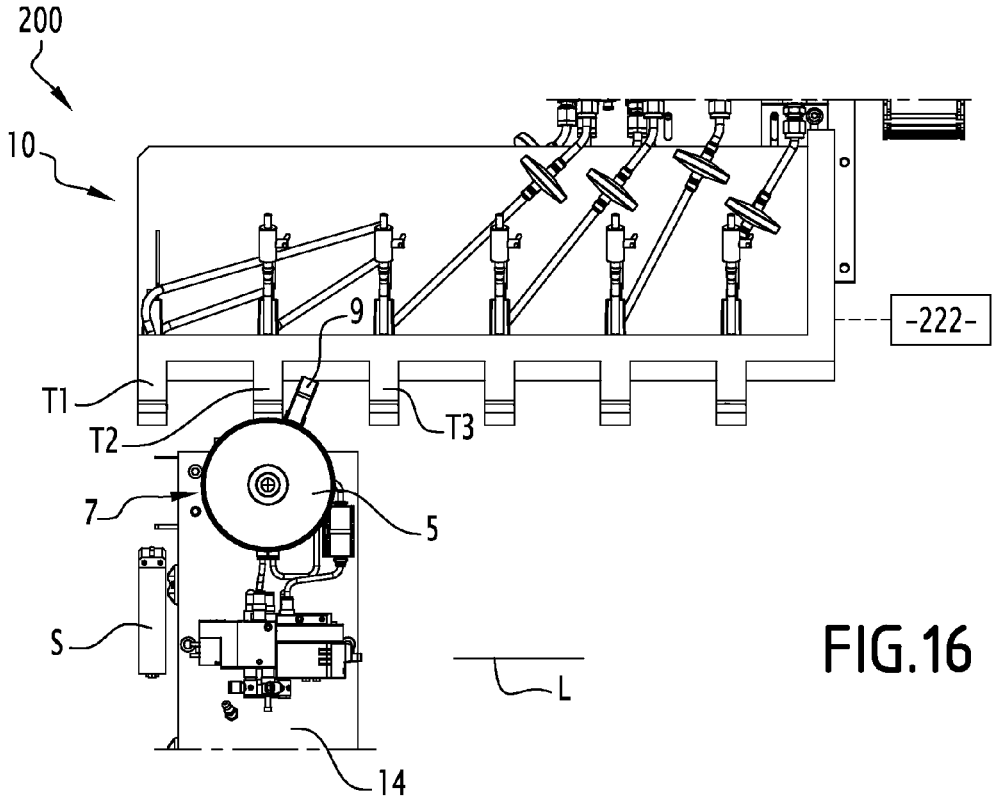

The printing by the printhead T2 begins and continues until the object 5 is in the final printing position relative to the printhead T2 (FIG. 16). The object 5 has then received a layer of ink, for example cyan, over the entire accessible outer surface 7. The drying has not yet begun.

Then, the command system 222 commands the actuating system 20 to move the support 14 from the second printing configuration (FIG. 16) to the third printing configuration (FIG. 17) and places the object 5 in the initial printing position relative to the printhead T3.

Figure 17:
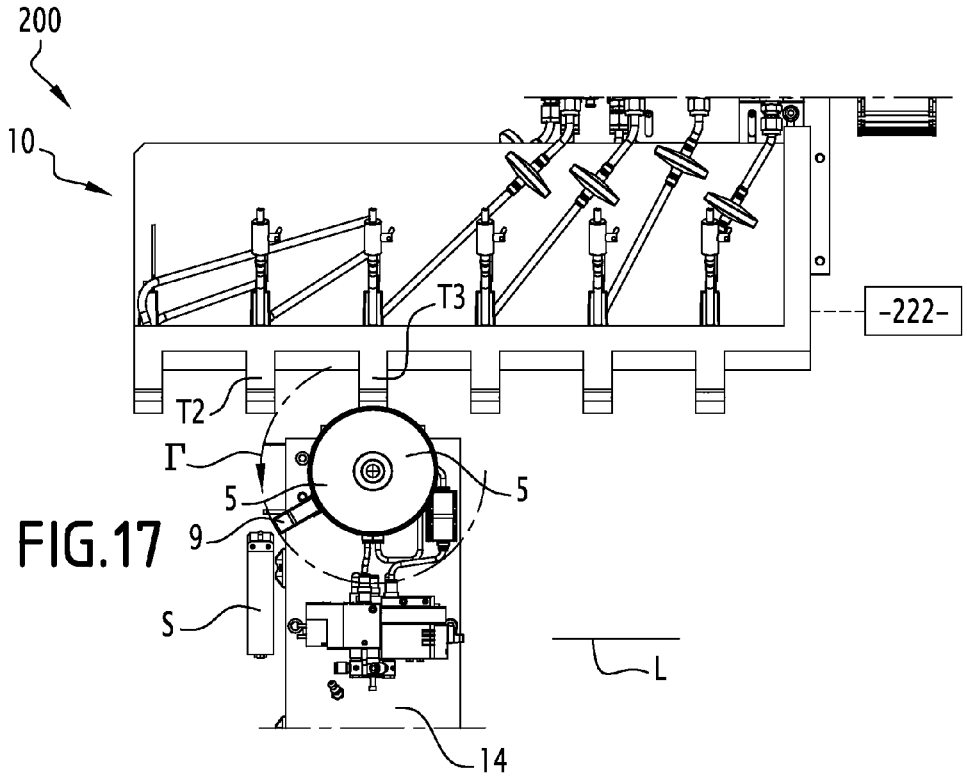

The printing of a layer of ink, for example magenta, by the printhead T3 begins. The rotation of the object 5 continuing, the handle 9 passes near the printhead T2, then near the drying device S without touching them, as shown in FIG. 17.

Figure 18:
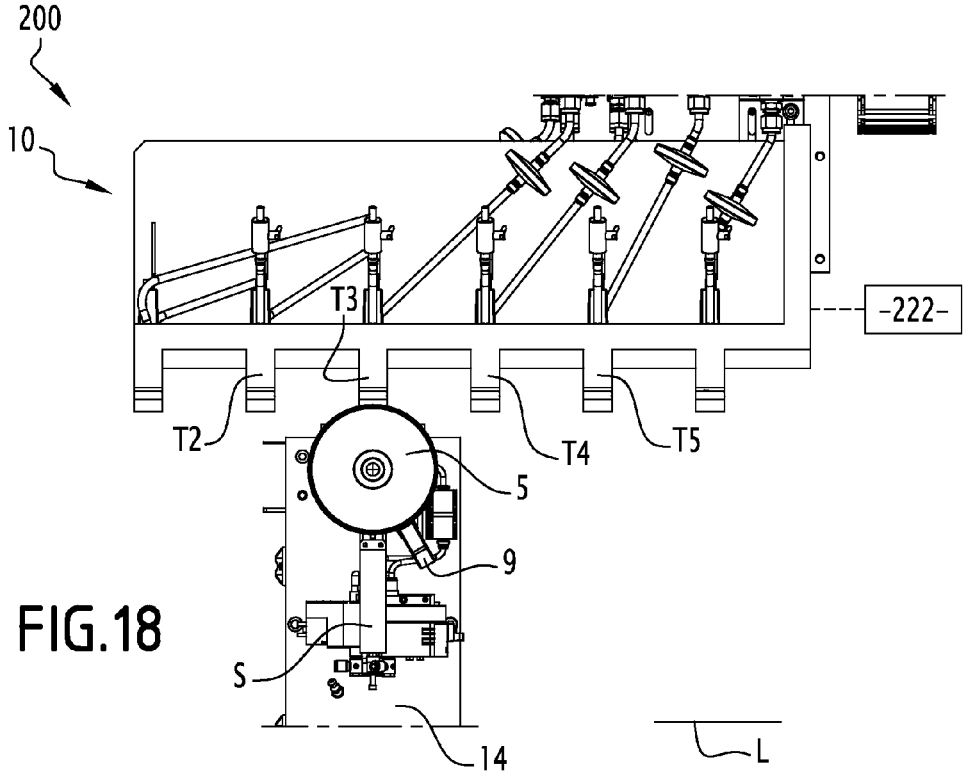

The command device 222 moves the drying device S from the first inactive position (FIG. 17) to the active position (FIG. 18). The object 5 is then in the initial drying position shown in FIG. 18. The drying of a double layer (cyan and magenta) begins.

Figure 19:
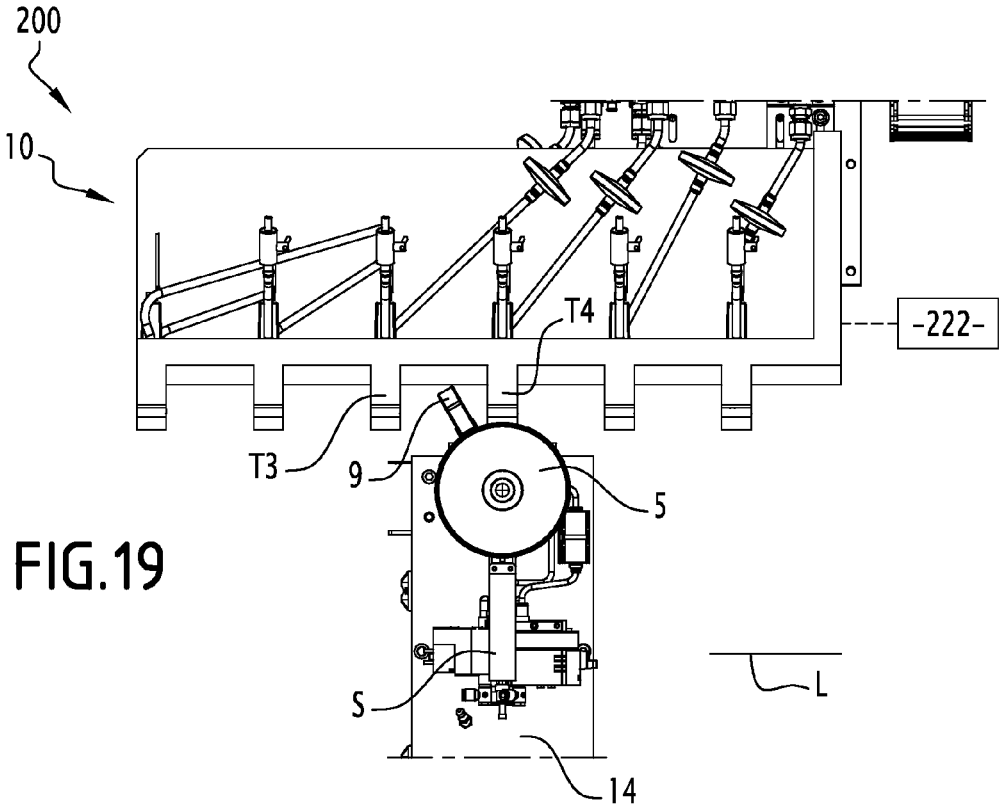

Next, the object 5 arrives in the final printing position relative to the printhead T3. The command device 222 moves the support 14 from the third printing configuration (FIG. 18) to the fourth printing configuration (FIG. 19).

The object 5 is then in the initial printing position relative to the printhead T4. The deposition of a third layer of ink, for example yellow, begins, while the drying device S continues to dry the layers of cyan and magenta ink.

Figure 20:
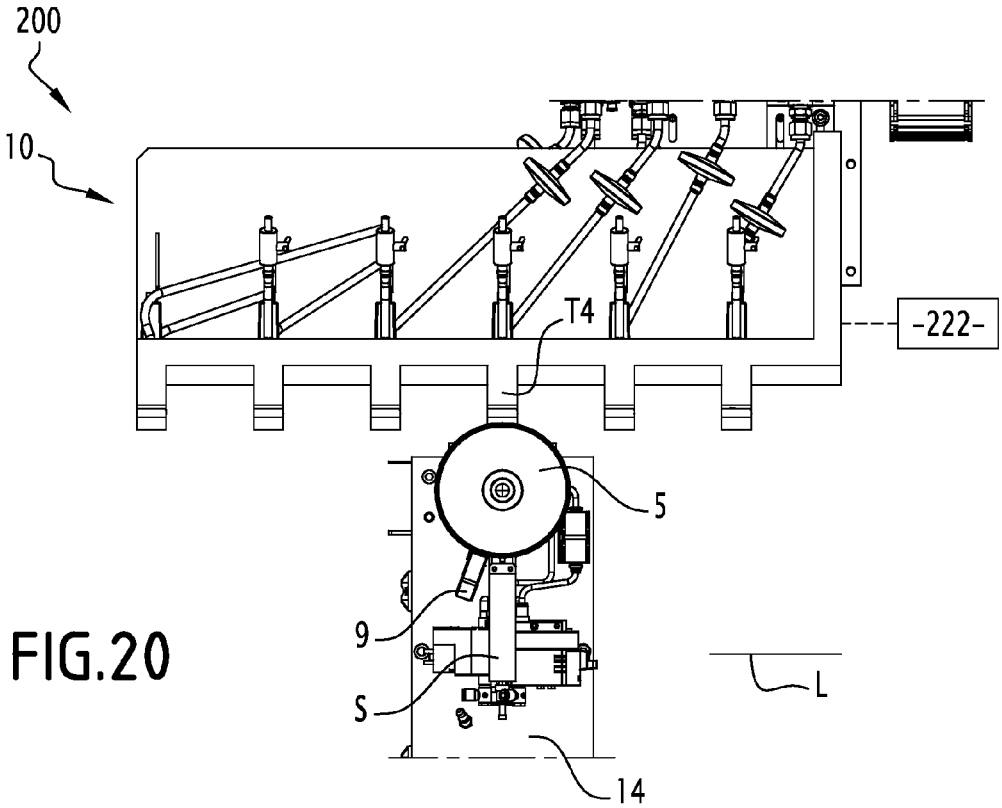

When the object 5 arrives in the final drying position shown in FIG. 20, the drying of the layers of cyan and magenta ink is completed, while the deposition of the layer of yellow ink continues.

Figure 21:
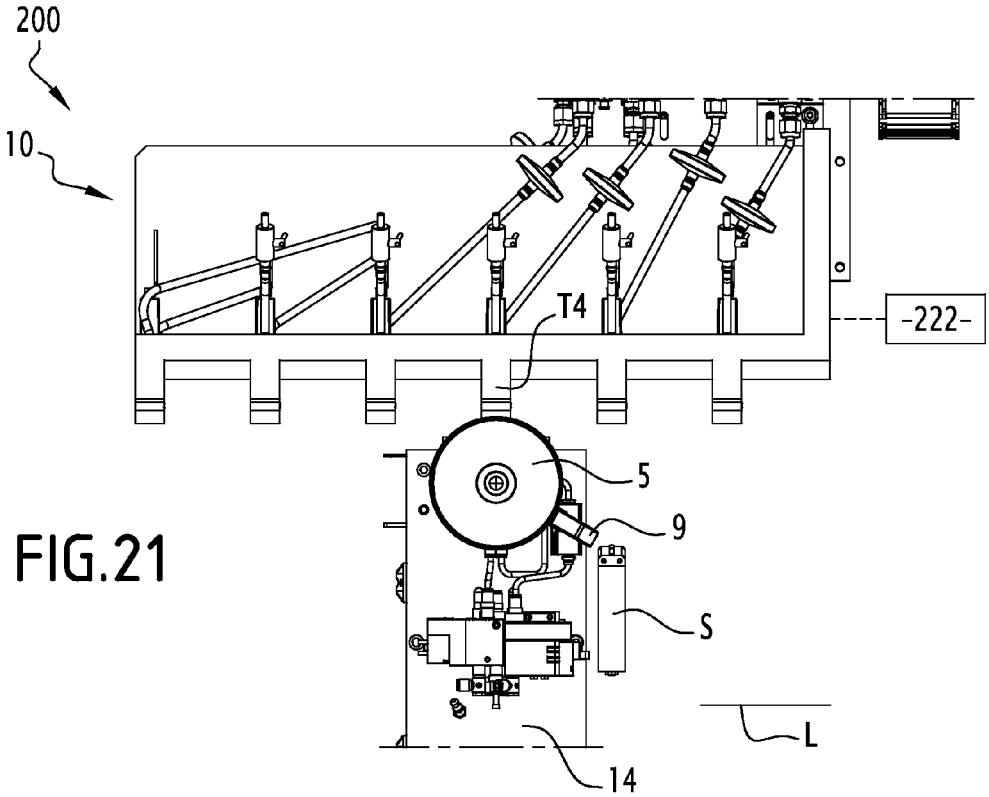

At that moment, the command system 222 moves the drying device S from the active position (FIG. 20) to the second inactive position (FIG. 21).

Figure 22:
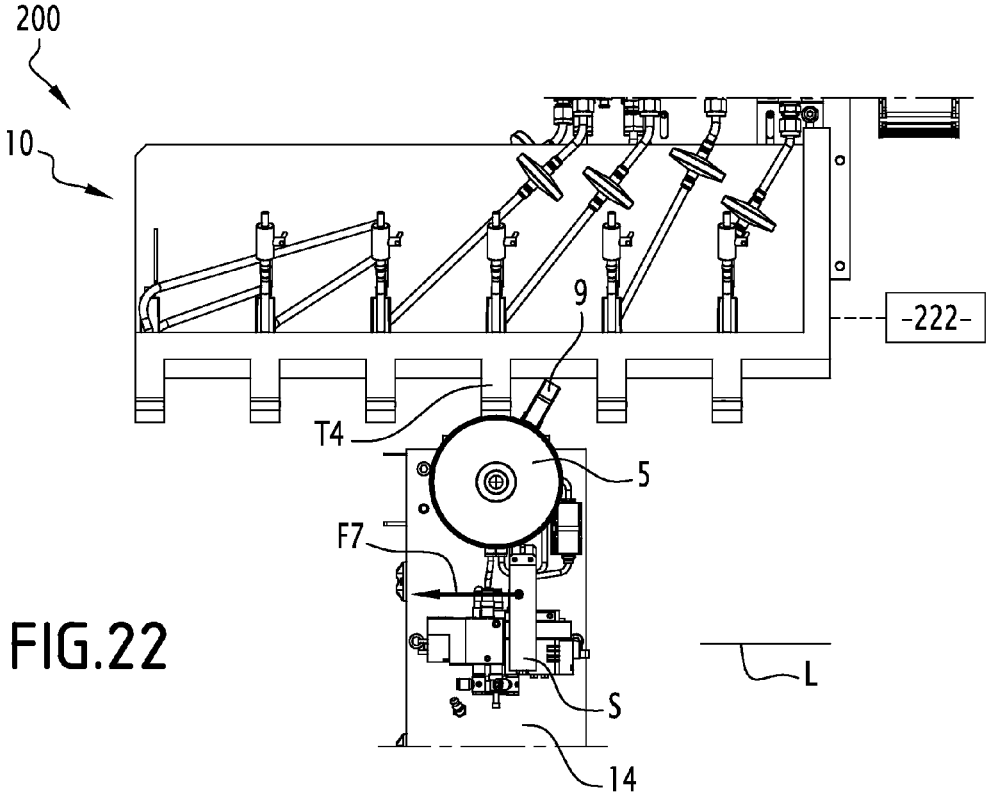

The rotation of the object 5 continuing, the handle 9 passes in the vicinity of the drying device S without touching it and continues its travel until the object 5 is found in the final printing position relative to the printhead T4 shown in FIG. 22. The deposit of the layer of yellow ink is then complete.

Once the deposit of the layer of yellow ink is completed by the printhead T4, the command system 122 moves the support 14 toward the fifth printing configuration. The command system 222 has moved the drying device S along an arrow F7 shown in FIG. 22 beforehand, from the second inactive position toward the first inactive position (FIG. 23), once the handle has passed the drying device S (position shown in FIG. 21). During the movement of the drying device S from the second inactive position toward the first inactive position, the drying system S is advantageously concealed or turned off to avoid creating a flash on the yellow printing, the partial drying on the surface being able to create a mark on the printing.

Figure 23:
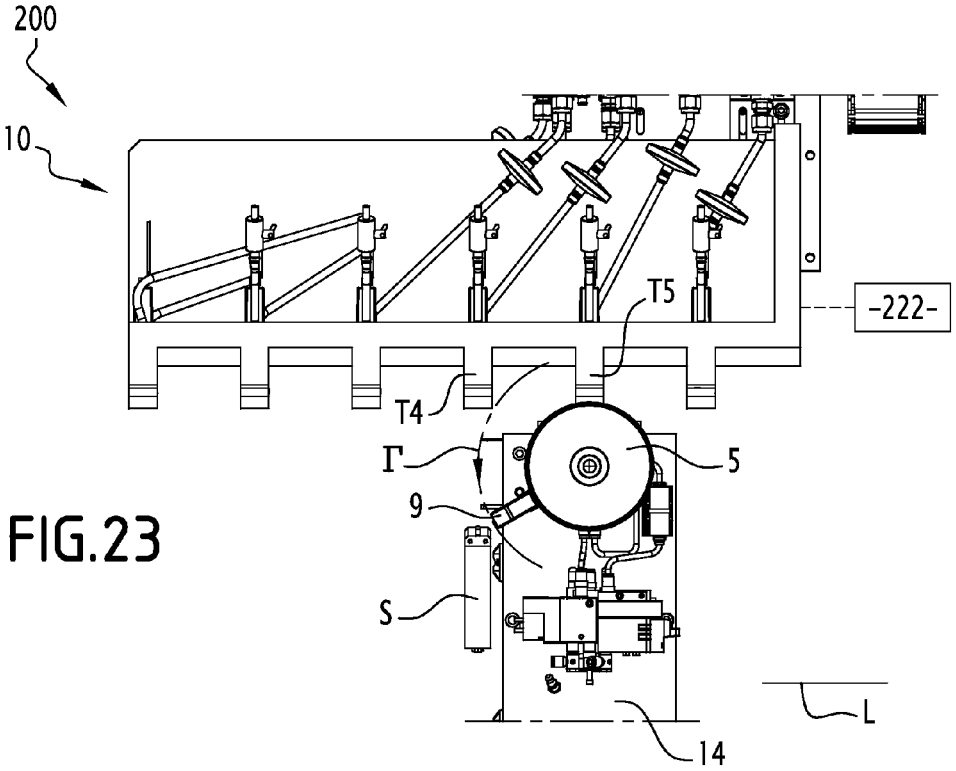
Figure 24:
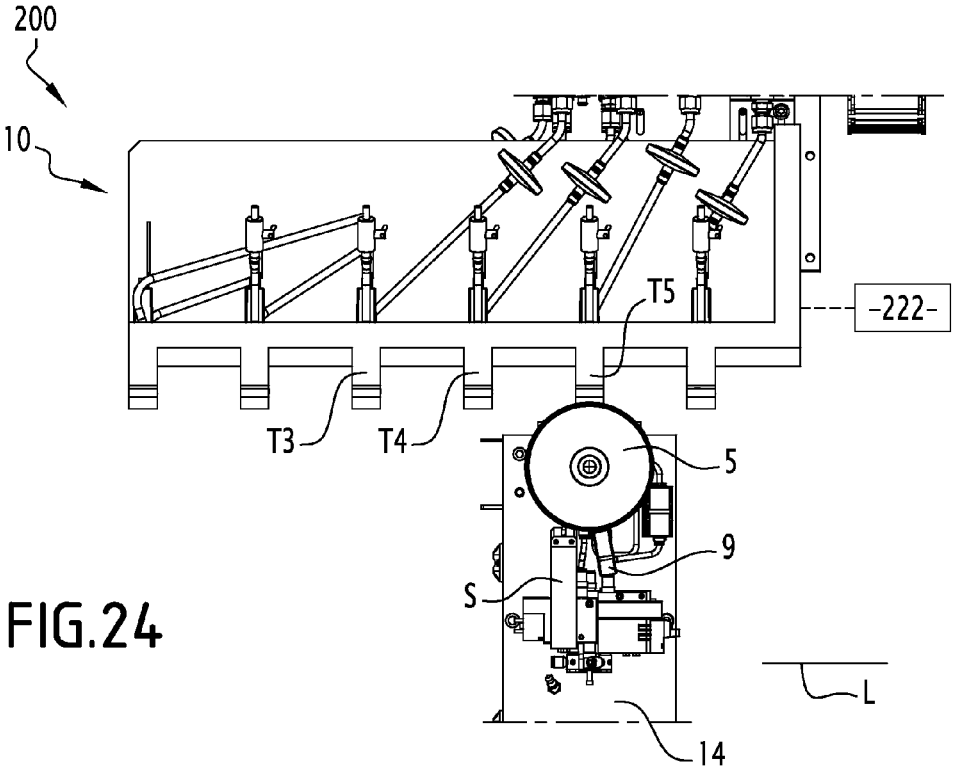

As shown in FIG. 23, the deposition of a fourth layer, for example black, by the printhead T5 has then begun. When the handle 9 has passed near the drying device S without touching it (FIG. 23), the command system 222 again moves the drying device S from the first inactive position (FIG. 23) to the active position (practically reached in FIG. 24). The object 5 is then in the initial drying position. The drying of two layers of ink, here yellow and black, then begins.

The assembly 200 is then in a configuration similar to that shown in FIG. 18, except that the support 14 is in the fifth printing configuration, and no longer in the third printing configuration.

Owing to the features described above, each of the inkjet printheads T1 to T6 deposits a layer of ink or varnish on the outer surface 7, with the exception of the portion defined by the angle α, without the handle 9 colliding with any of the printheads T1 to T6. The assembly 1 is capable of printing over practically the entire angular extension of the outer surface of the object, with the exception of the portion situated near the handle.

The advantages of the assembly 200 are similar to the advantages of the assembly 100, i.e., in particular the machine 10 is less expensive, having only one drying device S.

Furthermore, the number of revolutions performed by the object 5 around the axis Δ is minimized, since the drying is only done once two layers of ink have been deposited. The additional revolution done by the object 5 to deposit the third layer of ink allows the command system 222 to resituate the drying device S from the second inactive position to the first inactive position. Thus, the assembly 200 is both inexpensive and offers a higher printing rhythm than that of the assembly 100, comparable to that of the assembly 1.

Of course, an assembly combining the features of the assembly 1, but preferably with only two drying devices, and those of the assembly 100, regarding how the drying unit is used with two inactive positions, the passage from one to the other making it possible to rearm the drying unit, is an integral part of the invention.

Such a hybrid assembly is for example obtained starting from the assembly 100 as shown in FIGS. 8 to 14. It suffices to add at least one additional drying device in the drying unit 118. The additional drying device is for example positioned relative to the drying device S like the drying device S4 is relative to the drying device S3 in the drying unit 18 of the assembly 1.

The hybrid assembly works similarly to the assembly 1, in that the drying device S and the additional drying device are successively used in the same way as the drying devices S3 and S4 of the assembly 1.

Each of the drying device S and the additional drying device passes from a first inactive position to an active position, then to a second inactive position.

The operation of the hybrid assembly differs in that, after the handle 9 has passed near the additional drying device (in the same manner as in FIG. 12 when it passes near the drying device S), the command system moves the drying unit 118 (i.e., the two drying devices, and not only one as in the assembly 100) along arrow F6 shown in FIG. 13 to resituate the drying device and the additional drying device in the first inactive position. The drying unit is thus "rearmed".

The operation next continues like that of the assembly 1. In particular, the drying unit is ready to be used for two new successive drying operations without rearming the drying unit between them.

It will be understood that such a hybrid assembly has the advantages of the assembly 1 regarding the printing rhythm, and those of the assembly 100 regarding the reduction in the number of drying devices.

What is claimed is:

1. An assembly of at least one object and a machine for printing the object, the object having an outer surface substantially of revolution around an axis, and a handle protruding radially from the outer surface, the machine comprising:

at least four ink jet printheads, each printhead defining a median plane, at least one object holder designed to hold the object and a support, the object holder being fastened on the support, an actuator for moving the support relative to the printheads in at least four print configurations, the object in the at least four print configurations being respectively across from one of the printheads, the object holder being adapted to drive rotation of the object around the axis in each of the at least four printing configurations, a commander for commanding the actuator, the object holder and the at least four printheads, the commander configured, in each of the at least four printing configurations, to command the object holder to rotate the object relative to the corresponding printhead around the axis from an initial printing position, in which the handle is located near the corresponding printhead on one side of the median plane of the corresponding printhead, to a final printing position, in which the handle is situated near the corresponding printhead on the other side of the median plane, the handle being moved relative to the corresponding printhead following a circular trajectory, others of the at least four printheads being positioned away from the circular trajectory of the handle, the median planes being distributed along a movement direction and substantially perpendicular to the movement direction, and a drier for drying the ink, the dryer including a row of light emitting diodes.

2. The assembly as recited in claim 1 wherein:

each printhead includes a lower face designed to be across from the object, the lower face defining a thickness E in the movement direction, the outer surface and the handle respectively define a small radius R1 and a large radius R2 of the object from the axis, and two successive median planes are separated by a same distance greater than or equal to a minimum distance equal to the square root of the difference between the large radius R2 squared and the small radius R1 squared, plus half of the thickness E.

3. The assembly as recited in claim 2 wherein the distance is between the minimum distance plus 1 mm and the minimum distance plus 5 mm.

4. The assembly as recited in claim 1, wherein:

the initial printing position and the final printing position together define a nonprintable portion of the outer surface of the object, the nonprintable portion defining an angle relative to the axis, and the commander is configured on the one hand to command the actuator so as to move the support from a first printing configuration chosen from among the printing configurations to a second printing configuration, and on the other hand to command the object holder so as to simultaneously rotate the object relative to the support around the axis by an angle equal to said angle, the movement of the support and the simultaneous rotation of the object causing the object to go from the final printing position relative to the corresponding printhead in the first printing configuration, to the initial printing position relative to the corresponding printhead in the second printing configuration.

5. The assembly as recited in claim 1 wherein the drier defines a median drying plane and is movable relative to the object holder between an active position, in which the drier is able to dry at least one layer of ink deposited on the object, and at least one inactive position, in which the drier is at a sufficient distance from the axis to allow the handle to pass when the object holder rotates the object around the axis.

6. The assembly as recited in claim 5 wherein the commander is able to place the drier in the active position and to command the object holder to rotate the object relative to the drier around the axis of an initial drying position, in which the handle is situated near the drier on one side of the median drying plane, to a final drying position, in which the handle is situated near the drier on the other side of the median drying plane, then to move the drier from the active position to the inactive position, the rotation of the object continuing around the axis during said movement of the drier.

7. The assembly as recited in claim 5 wherein the commander is able to move the drier from the active position to the passive position by translating the drier relative to the support substantially in the movement direction.

8. The assembly as recited in claim 5 further comprising a base extending in a movement direction and a plurality of driers including the drier mounted on the base perpendicular to the movement direction so as to form a rake, the base being mounted movably in the movement direction relative to the support, each drier being suitable for drying at least one layer of ink respectively deposited by one of the printheads, the commander being configured to move the base in the movement direction relative to the support and to command the object holder so as to simultaneously rotate the object relative to the support around the axis, the movement of the base and the simultaneous rotation of the object causing the object to go from the final drying position relative to one of the driers to the initial drying position relative to the other of driers.

9. The assembly as recited in claim 5 wherein the drier is mounted movably in the movement direction on the support successively from a first inactive position, designed to be occupied while the drier has not yet dried one or more layers deposited by one or more printheads; toward the active position designed to be occupied when the drier is in the process of drying said layer of ink; and then toward a second inactive position, different from the first inactive position and designed to be occupied when the drier has dried said layer of ink.

10. The assembly as recited in claim 9 wherein the commander is suitable for placing the drier in the active position while a single layer of non-dry ink has been deposited on the object, and to command the object holder so that the object performs an additional revolution relative to the support around the axis during which the object is not receiving ink and during which the drier goes from the second inactive position to the first inactive position.

11. The assembly as recited in claim 9 wherein the commander is suitable for placing the drier in the active position while a second layer of non-dry ink is deposited on a first layer of non-dry ink, and for commanding the object holder so as to perform substantially one additional revolution of the object relative to the support around the axis during which the object receives ink and during which the drier goes from the second inactive position to the first inactive position.

12. The assembly as recited in claim 1 wherein the circular trajectory of the handle is uniform.

13. The assembly as recited in claim 1 wherein the median planes are distributed regularly in the longitudinal direction.

14. A method for printing at least one object, the object including a substantially cylindrical outer surface around an axis, and a handle protruding radially from the outer surface, the method comprising at least the following steps:

providing a machine for printing the object, the machine comprising: at least four ink jet printheads, each printhead defining a median plane, the median planes being distributed along a movement direction and substantially perpendicular to the movement direction; at least one object holder and a support on which the object holder is fastened; an actuator for actuating the support; a commander for commanding the actuator, the object holder and the printheads; and a drier for drying the ink, the dryer including a row of light emitting diodes;

carrying of the object by the object holder;

commanding the actuator via the commander and moving the support using the actuator relative to the printheads in at least four printing configurations in which the object is respectively across from one of the printheads;

in each printing configuration, commanding the object holder via the commander and rotating the object using the object holder around the axis from an initial printing position, in which the handle is situated near the printhead on one side of the median plane of the printhead, to a final printing position, in which the handle is situated near the printhead on the other side of the median plane, the handle being moved relative to the printhead along a circular trajectory, the others of the four printheads being positioned away from the circular trajectory of the handle; and commanding the printheads via the commander.

15. The method as recited in claim 14 wherein the circular trajectory of the handle is uniform.

* * * * *